US007096632B2

(12) United States Patent
Pacione

(10) Patent No.: US 7,096,632 B2
(45) Date of Patent: Aug. 29, 2006

(54) ANCHOR SHEET AND ATTACHMENT DEVICES

(76) Inventor: Joseph Rocco Pacione, R.R. #2, 1865 Highway 9, Newmarket, Ontario (CA), L3Y 4V9

( * ) Notice: Subject to any disclaimer, the term of this patent is extended or adjusted under 35 U.S.C. 154(b) by 181 days.

(21) Appl. No.: 10/004,834

(22) Filed: Dec. 7, 2001

(65) Prior Publication Data

US 2002/0124515 A1 Sep. 12, 2002

Related U.S. Application Data

(63) Continuation of application No. PCT/CA00/00681, filed on Jun. 7, 2000, which is a continuation-in-part of application No. 09/326,634, filed on Jun. 7, 1999, now abandoned.

(51) Int. Cl.
*A47G 27/04* (2006.01)
*A47G 27/02* (2006.01)

(52) U.S. Cl. ..... 52/506.05; 52/509; 52/512; 52/391; 52/403.1; 52/DIG. 13

(58) Field of Classification Search ..... 52/506.05, 52/391, 509, 512, 311.1–316, 511, 403.1, 52/591.4, DIG. 13, 392
See application file for complete search history.

(56) References Cited

U.S. PATENT DOCUMENTS

| | | | | | |
|---|---|---|---|---|---|
| 644,138 | A | | 2/1900 | Ketchum | |
| 652,716 | A | | 6/1900 | Furness | |
| 748,746 | A | * | 1/1904 | Kelsey | 52/509 |
| 1,673,630 | A | * | 6/1928 | Madge | 404/32 |
| 1,929,871 | A | | 10/1933 | Jones | |
| 2,012,929 | A | | 8/1935 | Knowland | |
| 2,735,523 | A | * | 2/1956 | Leyerle et al. | 52/509 |
| 3,002,868 | A | | 10/1961 | Boivin | |
| 3,247,638 | A | | 4/1966 | Gay, Jr. | |
| 3,583,057 | A | | 6/1969 | Kolozsvary | |
| 3,711,349 | A | | 1/1970 | Snyder et al. | |
| 3,522,637 | A | | 8/1970 | Brumlik | |
| 3,574,019 | A | | 4/1971 | Girard | |

(Continued)

FOREIGN PATENT DOCUMENTS

| | | |
|---|---|---|
| AU | 40926/72 | 5/1971 |
| BE | 853033 | 7/1977 |

(Continued)

OTHER PUBLICATIONS

Shikishima Boseki KK; Patent Abstracts of Japan JP2088015, Mar. 28, 1990.
Tokyo Ink KK; Patent Abstracts of Japan JP57011279, Jan. 20, 1982.

*Primary Examiner*—Jeanette Chapman
(74) *Attorney, Agent, or Firm*—McCarthy Tétrault LLP; Brian W. Gray

(57) ABSTRACT

A method and apparatus for connecting anchor sheets to each other and/or to a floor. The approach includes using attachment pieces which fit into an area of reduced thickness of the anchor sheet which surround a cut away of the anchor sheet. In one embodiment, the attachment pieces are corner pieces which overlap areas of reduced thickness on a number of anchor sheets.

7 Claims, 5 Drawing Sheets

U.S. PATENT DOCUMENTS 3,708,833 A 1/1973 Ribich
3,712,845 A 1/1973 Hartung
3,735,988 A 5/1973 Palmer
3,775,856 A 12/1973 Schmidt
3,817,015 A 6/1974 Frangos
3,866,267 A 2/1975 Poletti
4,405,668 A 9/1983 Wald
4,430,837 A 2/1984 Kirschenbaum
4,489,115 A 12/1984 Layman et al.
4,528,783 A * 7/1985 Muir ..... 144/355
4,557,774 A 12/1985 Hoopengardner
4,577,448 A 3/1986 Howorth
4,578,910 A * 4/1986 Germeroth et al. ..... 52/105
4,638,618 A 1/1987 Iesaka et al.
4,649,069 A 3/1987 Tone
4,671,976 A 6/1987 Vidal
4,673,603 A 6/1987 Roth
4,697,294 A 10/1987 Schafer
4,755,401 A 7/1988 Friedrich
4,766,022 A 8/1988 Tone
4,769,895 A 9/1988 Parkins
4,770,917 A 9/1988 Tochacek
4,797,170 A 1/1989 Hoopengardner
4,810,546 A 3/1989 McLaughlin
4,822,658 A 4/1989 Pacione
4,824,498 A 4/1989 Goodwin et al.
4,825,477 A 5/1989 Aranda
4,829,627 A 5/1989 Altus et al.
4,922,670 A 5/1990 Naka et al.
4,968,548 A 11/1990 Gibson et al.
4,974,384 A 12/1990 Pacione
5,042,221 A 8/1991 Pacione
5,045,389 A 9/1991 Campagna
5,060,443 A 10/1991 Pacione
5,116,439 A 5/1992 Raus
5,133,166 A 7/1992 Pacione
5,144,786 A 9/1992 Pacione
5,149,573 A 9/1992 Kobe et al.
5,191,692 A 3/1993 Pacione
5,200,245 A 4/1993 Brodrick, Jr.
5,259,163 A 11/1993 Pacione
5,382,462 A 1/1995 Pacione
5,386,670 A * 2/1995 Takeda et al. ..... 52/126.6
5,398,347 A 3/1995 Luedtke et al.
5,479,755 A 1/1996 Pacione
5,482,755 A 1/1996 Manning
5,529,825 A 6/1996 Sutherland
5,537,793 A 7/1996 Murasaki
5,654,066 A 8/1997 Pacione
5,672,404 A 9/1997 Callahan, Jr. et al.
5,691,026 A 11/1997 Zinke et al.
5,691,027 A 11/1997 Eckhardt et al.
5,723,195 A 3/1998 Pacione
5,753,336 A 5/1998 Stull
5,832,619 A 11/1998 Volkema, Jr.
5,863,637 A 1/1999 Mansson et al.
5,879,777 A 3/1999 Shipley
5,902,663 A 5/1999 Justesen et al.
5,965,232 A 10/1999 Vinod
5,980,230 A 11/1999 Dowd et al.
6,083,596 A 7/2000 Pacione
6,158,185 A 12/2000 Counihun
6,182,414 B1 2/2001 Huang
6,199,328 B1 3/2001 McGrath et al.
6,217,974 B1 4/2001 Pacione
6,250,001 B1 6/2001 Gillespie
6,298,624 B1 10/2001 Pacione
6,306,477 B1 * 10/2001 Pacione ..... 428/62
6,395,362 B1 * 5/2002 Pacione ..... 428/45
6,599,599 B1 7/2003 Buckwater et al.

FOREIGN PATENT DOCUMENTS

DE 7029524 11/1970
DE 2012523 2/1972
DE 2201231 7/1973
DE 2245915 4/1974
DE 2803006 8/1979
DE 4228597 3/1994
DE 19532685 3/1997
DE 197 24 698 A1 12/1998
EP 0161637 11/1985
EP 0 455 926 A1 11/1991
EP 0 860 543 A2 2/1998
FR 2328432 5/1977
FR 2362257 3/1978
FR 2582210 11/1986
FR 2747605 10/1997
GB 11747 of 1892
GB 1204886 9/1970
GB 1376262 12/1974
GB 1546901 5/1979
JP 5374719 7/1978
JP 5981479 6/1984
JP 10-118988 5/1998
WO WO 86/01247 2/1986
WO WO 95/03723 2/1995
WO WO 98/03104 1/1998
WO WO-99/35943 A1 7/1999
WO WO 99/35944 7/1999

* cited by examiner

ANCHOR SHEET AND ATTACHMENT DEVICES

This application is a continuation application of PCT/CA 00/00681 filed Jun. 7, 2000 designating the United States, which application is a continuation-in-part of U.S. patent application Ser. No. 09/326,634 files Jun. 7, 1999, abandoned. Both of these prior applications are incorporated herein by reference.

INTRODUCTION TO THE INVENTION

This invention concerns improvements to attach a flexible but relatively rigid anchor sheet for use under carpets or other decorative coverings as described in current inventor's U.S. applications Ser. Nos. 08/850,726 filed May 2, 1997, 09/008,565 filed Jan. 16, 1998 and 09/008,584 filed Jan. 16, 1998. This application incorporates by reference the teachings of these earlier applications except where those teachings may have been modified by new developments as set out herein. The current inventor has invented an anchor sheet which, when installed, acts to tie decorative covering together as a functional unit and to add mass and stability to such unit, particularly in the case of a unit having a flexible decorative covering such as a carpet. The anchor sheet may be substantially covered over one side with hooks for anchoring a decorative covering to it by engagement of complementary loops on the under side of the decorative covering. The anchor sheet itself may be attached to the underlying substrate, such as a floor or wall, or it may be loose laid on a floor where the anchor sheet can have sufficient mass so as to prevent movement of the anchor sheet. The present invention provides attachment devices so as to minimize attachment of the anchor sheet to the underlying substrate, and to allow for the possibility of spacing between anchor sheet units in order to accommodate atmospheric changes. It is possible to supply the anchor sheet in modular units of various geometric shapes and sizes with corresponding complementary comer pieces.

BACKGROUND OF THE INVENTION

The earlier cases by the same inventor Pacione disclose an anchor sheet which can be supplied as a small or large module, with or without a pre-attached decorative covering. These earlier cases also disclose the anchor sheet as a modular unit which can form a contiguous mass of anchor sheet. Such a contiguous mass can be formed by attaching the anchor sheets together by some form of overlap or by abutting the anchor sheets to each other and using an overlap of decorative covering or tape. Such mass can be free floating or attached to the floor

SUMMARY OF THE INVENTION

The current invention relates to attachment devices for such modular anchor sheets which when abutting or overlapped can be held to the underlying floor by the use of the attachment devices or glued together by use of the attachment devices so as to form totally or partially free floating units. In particular, if the attachment devices are attached to the underlying substrate by means of the structure shown in this application, the anchor sheets can be made more relatively free floating, which can provide for expansion and contraction between the modular sheets.

There are advantages to having the anchor sheet attached at only a few discrete attachment points, or even in some cases not attached at all so as to be easily removeable. If the anchor sheet covering is formed from modular units and is attached in such a way that there is some relative movement between the modules, this will allow for a more stable anchor sheet product which can expand and contract to accommodate atmospheric changes such as temperature and humidity. It is envisaged that the anchor sheet can be made of polyethylene or polypropylene, but even these materials change in size as much as one-quarter inch over the size of a normal room because of temperature changes. Therefore, there are advantages to allowing some form of spacing or floating between the modular units. In addition, there are advantages to providing for a system whereby the anchor sheets form a contiguous mass without a large number of attachment locations to the underlying substrate and without having to drill through the anchor sheets themselves.

Frequently, it is advisable to form a two-layer anchor sheet as shown, for instance in FIG. 31 in patent application Ser. No. 09/008,565. The top and bottom layers are offset from each other so as to form an overlap or underlay on each module matched with the corresponding overlap or underlay on a corresponding module. Two layers can be attached by hook and loop or glued, co-extruded together, or injection moulded to form a modular piece. Typically, such modular piece would be in the form of a square tile Typically, areas where the tiles abut, particularly the corners, could be areas of weakness where the anchor sheet might shatter or break, or where areas of discontinuity on the surface of the anchor sheet may become apparent In order to minimize attachment of these modular forms of anchor sheet to the underlying substrate and also to provide for the possibility of floating between such anchor sheets, the applicant has invented a new attachment structure which includes a modification to the anchor sheet itself generally at the comers and a corresponding complementary cornerpiece in a matching geometric relationship which presses and holds the four corners together to the substrate while at the same time allowing for the anchor sheets to ride underneath the cornerpiece when required in order to provide for expansion and contraction.

Thus, the invention in one aspect consists of an anchor sheet having edges and comprising a generally polygonal anchor sheet having a cut of a pre-determined first geometric shape reducing the thickness of the anchor sheet in a first area surrounding the apex of the angles of the edges of the sheet, the sheet having a second cutaway portion of a smaller second area within the first area of a pre-defined second geometric shape, so that when the anchor sheet is laid side by side along its straight edges with a corresponding anchor sheet, the respective first area and second area line up to form a first reduced thickness area at the corner surrounding the point where the apexes of the sheets would have met and a second cut-away area within the first area so that the anchor sheet is cut away at the point where the apexes of abutting anchor sheets would otherwise meet.

Matching the geometric areas formed by the first reduced thickness area and second cutaway portions of the polygonal anchor sheets are complementary matching cornerpieces. The complementary matching cornerpieces are in their area of maximum thickness the same as the thickness of a complementary anchor sheet, and are of an overlapping geometric shape matching the first reduced thickness portion and having an underlay matching the second cut away geometric shape defined by the abutting anchor sheets.

The invention can also be adapted to anchor sheets which are overlapped as previously described in the Pacione applications referred to above. In this aspect the invention consists of an anchor sheet for anchoring a decorative covering to a floor in which a generally polygonal sheet having at least one edge which has a lower portion which has been cut away to create an overhanging area of anchor sheet along that edge and a first lower portion edge under the overhang and at least a second edge of the anchor sheet has an upper portion cut away to create an underlaying area of a second lower portion edge along that second edge so that the overhanging area of one anchor sheet can overlap the underlaying area of an abutting second anchor sheet, the improvement which comprises a first area of reduced thickness surrounding the apex of the angles formed by the edges of the first and second lower portions and a second smaller area within the first area cut away around the point where the apexes of lower portions of abutting anchor sheets would meet.

DESCRIPTION OF PREFERRED EMBODIMENTS

Figure 1:
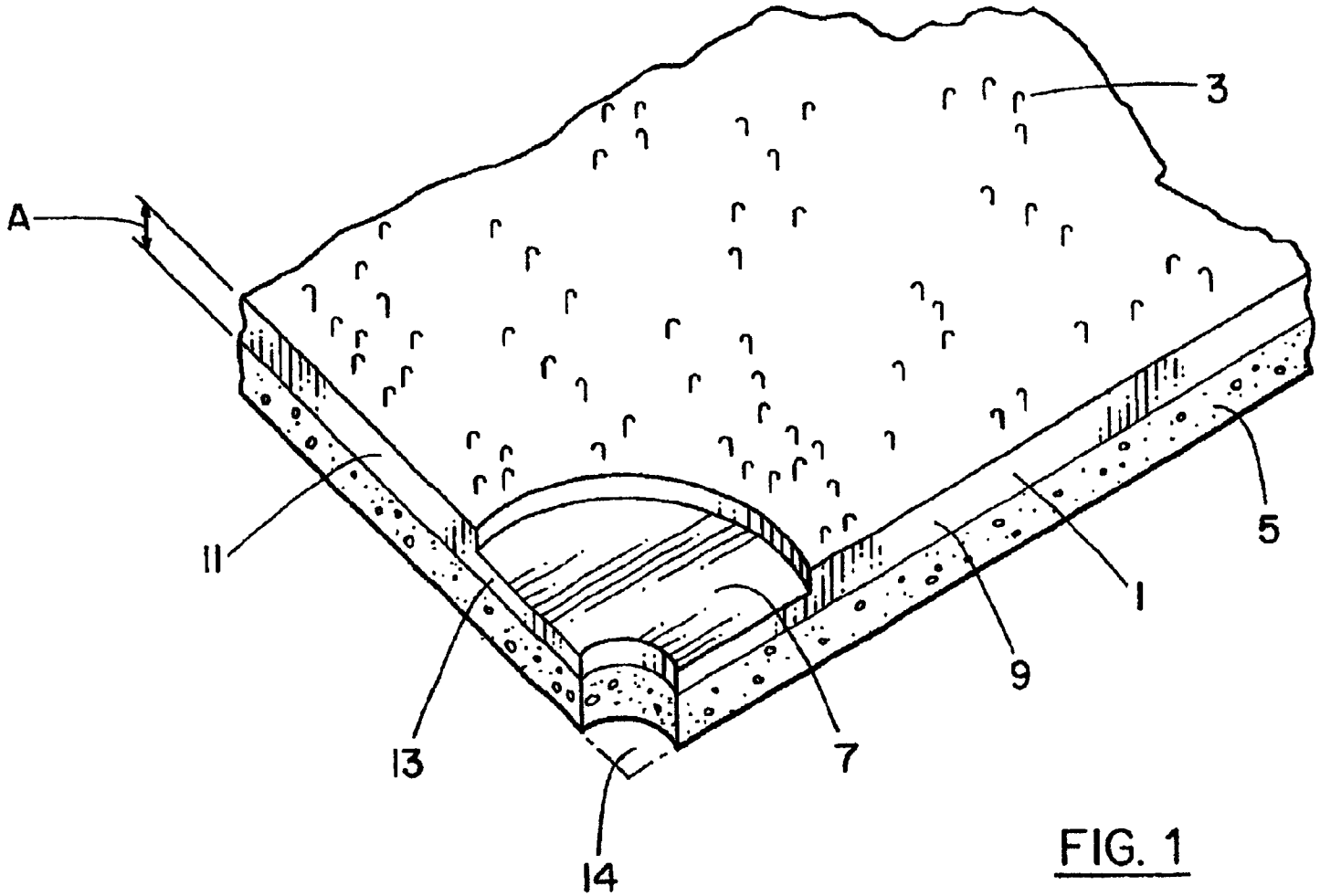
FIG. 1 shows an anchor sheet in a simple form with an underpad according to this invention.

As shown in FIG. 1, an anchor sheet 1 is provided, which in this case is in the shape of a square, one of the preferred shapes. It is also possible to have the anchor sheet 1 provided in any shape that can be conveniently abutted with another similar piece to create a floor pattern such as, for instance, a rectangle, a hexagon or an octagon. Generally the preferred shape will be an equilateral polygon but a rectangle may also work in some cases. The anchor sheet 1 contains a top surface layer 3 having hooks. In this embodiment anchor sheet 1 also contains the cushion 5 to provide resilience to the anchor sheet and to a decorative covering, such as for example, a carpet overlaid on top of the anchor sheet. However, cushioning is not necessary for the functioning of anchor sheet 1, but such cushioning can have advantages depending on the overlayment to be used and the intended use of the anchor sheet. In alternative embodiments, cushion 5 may also be replaced with a structure that will provide roughly equivalent resiliency to a cushion 5.

In practice, the hooks of the top surface layer 3 will be attached to the loops of an overlying carpet (not shown) when an entire anchor sheet subfloor has been installed. The anchor sheet has a thickness A. The appropriate thickness A will depend on the intended use of the anchor sheet, and may vary with the type of overlayment to be used. The thickness A will not be substantially less than 0.020 inches and generally will not be less than 0.062 inches. The preferred thickness A is around 0.125 inches, but the thickness A may be as much as 0.75 inches, for example in situations where a thick floor is to be replaced, or where a thick anchor sheet needs to be used to create a level surface with an adjacent surface. Cutaway from that thickness is an area 7 which will be shaped into some geometric shape, in this case a portion of a circle, so that when combined with similar abutting anchor sheets aligned along sides 9 and 11, a ¾ circular cut out area will be formed. A fourth anchor sheet diagonally opposite anchor sheet 1 will form a complete circle having a circular cut out area and a "hole" 14 as described below. Typically, the cut-out area will be such that the width of the anchor sheet at 13 will be approximately half of the total thickness A of the anchor sheet. However, the width of the anchor sheet at 13 may be other than approximately half the total thickness A and still incorporate the teachings of this patent. In addition, there is a second area 14 which has been cut away from the corner (the apex of the angle formed by the two sides of the square). This second area 14 also has a geometric shape, in this example a ¼ of a circle, so that when combined with other anchor sheets, the anchor sheet edges are lined up so that their corners meet at the imaginary intersection of the four corners, and a second smaller circle will be formed in the completed anchor sheet structure.

Figure 2:
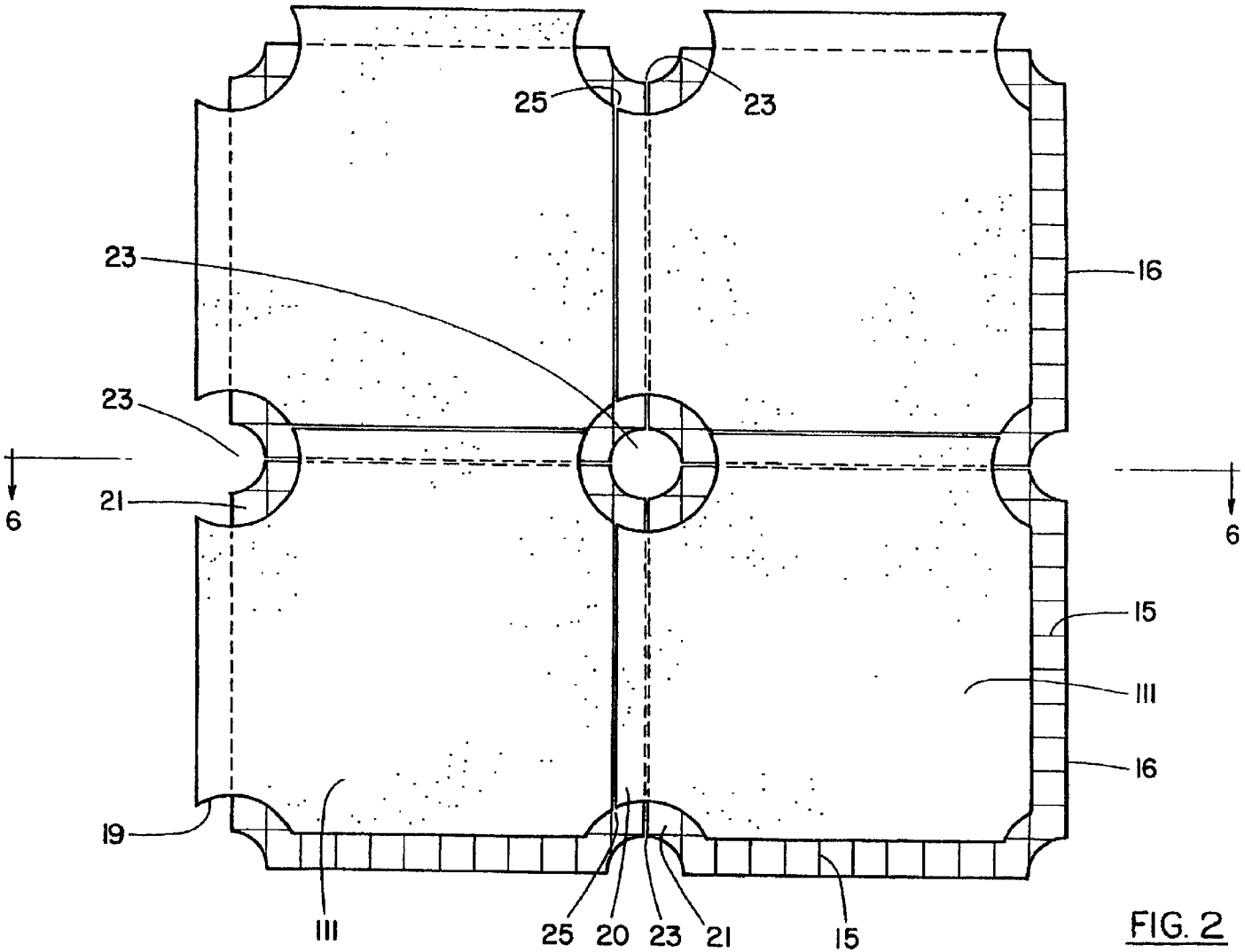
FIG. 2 shows an anchor sheet in plan view having overlapping edges in addition to the cutaway portions for the cornerpieces.
Figure 3:
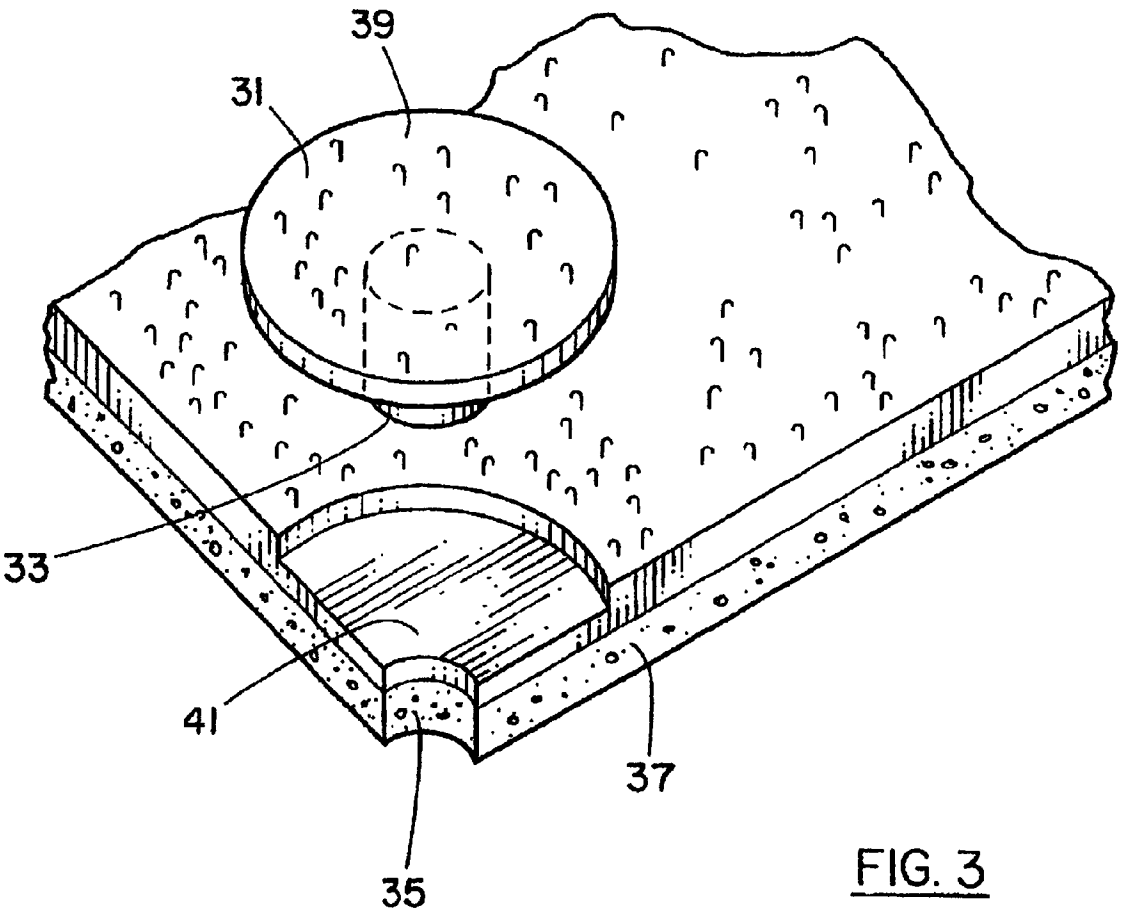
FIG. 3 shows the cornerpiece to be used with certain geometric shapes of anchor sheets.
Figure 4:
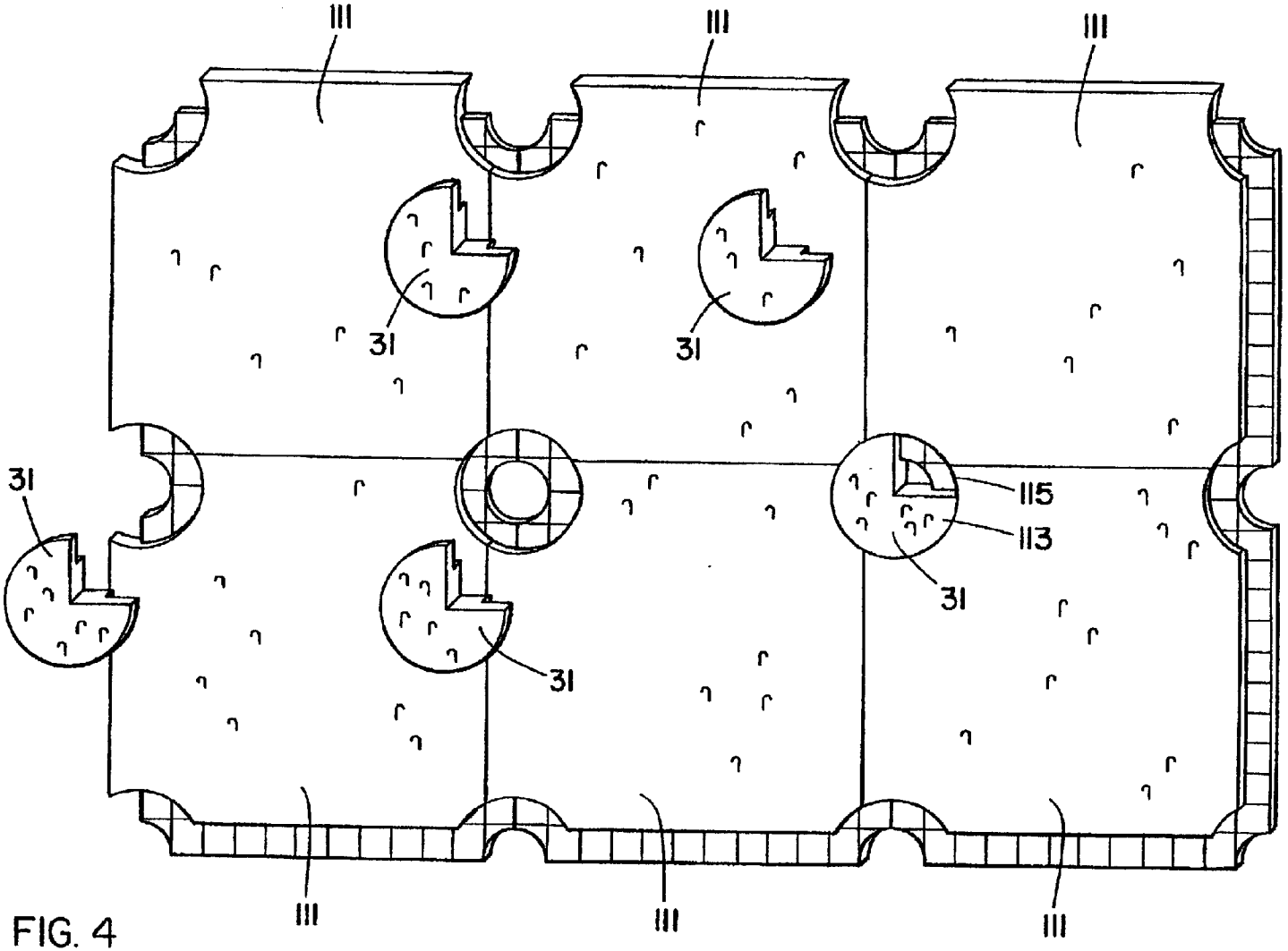
FIG. 4 shows the anchor sheet and comer piece (in partial section).

Thus, a circular cut away area 14 within a second larger circular cut out area 7 is created when four similar anchor sheets abut each other as shown in FIG. 2. A complementary corner piece can then be added which will match the shape and thickness of the reduced thickness portion and the shape and thickness of the cutaway area as shown in FIGS. 3 and 4. This corner piece can be attached to area 7 by glue or other permanent attachment, or by detachable attachment such as pressure sensitive adhesive or a hook and loop Fastening devices such as hook and loop or a screw or nail can be used to attach the corner pieces to a floor thereby holding the anchor sheet to the floor at only a few discrete points by use of the comer pieces, with or without direct attachment to the anchor sheets.

Only a minimal number of comer pieces may need attachment to the floor to stabilize the unit. The comer pieces generally need to be attached to the anchor sheet or to the floor. In some cases, the comer pieces are not attached to the floor but only to the anchor sheets themselves so as to allow the complete unit to float freely over the floor. If the comer pieces are only attached to the floor, the anchor sheets can "ride" under them. In some installations, some of the comer pieces will be attached to the floor while other corner pieces are only attached to the anchor sheets.

Alternatively, if the comer pieces are attached to the anchor sheets at area 7 by glue or some other means of attachment, then the whole unit can free float by not attaching the comer pieces to the floor.

The arrangement of anchor sheet modules and comer pieces where there are overlapping anchor sheets can be seen in FIG. 2. In FIG. 2, a plurality of anchor sheets 111 are shown. In this example they are squares. Unlike the embodiment in FIG. 1 however, these anchor sheets 111 do not abut each other in one plane only. Rather, the anchor sheets 111 in this embodiment have an underlay area 15 in which there is a lower portion edge 16. Underlay area 15 is indicated in FIG. 2 by a grid marking, but underlay area 15 is part of anchor sheet 111. Underlay area 15 lies under the overlap area 19 on an adjacent sheet. The overlap area 19 in this example extends on two sides of each sheet, whereas the underlay area 15 extends on the other two sides. The overlap area 19 overlaps the underlay area 15 of each sheet, for instance along the area 20 shown in FIG. 2 (the area between the top abutment edge at the dotted line). An area of reduced thickness 21 is formed surrounding where the apex of the underlay edges 15 would have been of the square. In this case, the cutout is centred over the area of abutment for instance at 23 of the lower portion edges of the anchor sheet. It is not centred over the corner line of abutment 25 created by the overlap edges extending over the area of overlap 19. In addition to the reduced thickness area 21 (similar to area 7 in FIG. 1) there is a completely cutaway portion 23.

FIG. 3 shows a comer piece 31 which consists of a lower portion 33 which matches in geometric shape the cutaway portion 35 shown in FIG. 3, a shape that will be formed by all of the abutting pieces 37 of lower edge portions of anchor sheet. (This lower portion 33 will therefore normally be shaped to correspond to the shape of the cut away portion 23 from FIG. 2) In this case, it is a simple circle. This will be the preferred shape, although, of course polygons or other shapes are also possible and the upper portion of the corner piece 39 need not be the same shape as the cut away portion 35.

The upper portion of the comer piece 39 will be shaped to correspond to the cutaway portion 41. Again, this is a circle but could be another shape, particularly an equilateral polygon. In FIG. 3 the corner piece could be attached to the anchor sheet in the cutaway portion area 41 and thus form an attachment between four contiguous anchor sheets modules. Typically, if the corner pieces are attached to the floor but not to the anchor sheets, the radius of lower portion 33 will be less than the radius of cut-away portion 35, and the radius of upper portion of comer piece 39 will be less than the radius of cutaway portion 41 to allow for atmospheric expansion of the anchor sheets.

In cases where the corner pieces are only going to be attached to the anchor sheets (allowing the anchor sheets and comer piece subfloor to free-float over the floor), it is not necessary to have cut-away portion 35 in the anchor sheet and corresponding lower portion 33 in the corner piece. In this case, the lower surface of upper portion of the corner piece 39 will be attached to cutaway portion 41.

FIG. 4 shows illustrates the use of corner pieces 31 of FIG. 3 with the anchor sheets 111 of FIG. 2. Corner pieces 31 are shown in partial section view. Specific corner piece 113 is shown placed within circle 115 created by the corners of the four adjacent anchor sheets 111.

Figure 7:
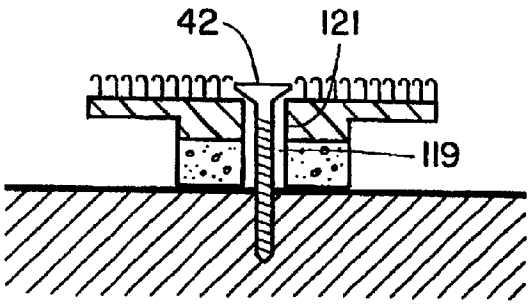
FIG. 7 is a plan view of a comer piece(on the same page as FIG. 5).

The comer pieces 31 could be attached to the underlying floor by use of a screw 42 as shown in FIG. 7, or the anchor sheet could remain free-floating if there is sufficient mass to provide for stability, particularly when an overlying decorative covering, such as a carpet, is attached to the anchor sheet. Space 119 may be maintained in the screw hole 121 by having the radius of screw hole 121 be larger than the radius of screw 42, allowing for movement of the corner pieces 31.

Figure 5:
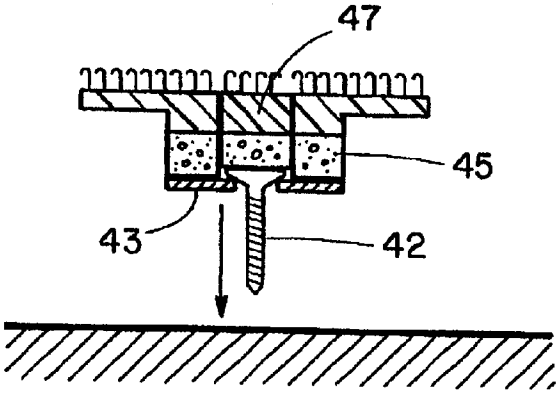
FIG. 5 shows a comer piece in section with attached cushion and countersunk attachment points.

As shown in FIG. 5, it is also possible to have the screw countersunk. In this case if the anchor sheet has a cushion 45, a rigid layer 43 is provided attached to the cushion 45. A plug 47 is removed from the rigid layer 43 and cushion 45. After the screw has been attached to the subfloor, the plug 47 is reinserted to create a smooth upper surface of cushion and anchor sheet, or the plug can simply be filled with cushion or any other suitable material.

Figure 6:
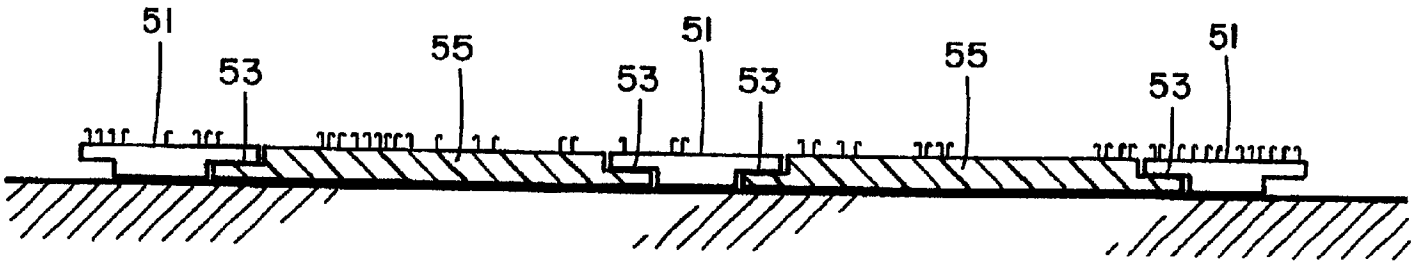
FIG. 6 is a section view of an anchor sheet along the lines 6—6 in FIG. 2 (on the same page as FIG. 5).

FIG. 6 is a section taken along the line 6—6 in FIG. 2. It shows corner pieces 51 which overlap areas of reduced thickness 53 on anchor sheets 55. The anchor sheet 55 can be free to ride between two corner pieces 51, especially if there has been a tolerance or space built in to the spacing between anchor sheets 55 and corner pieces 51 as described above. In this case, corner pieces 51 would normally be attached to the underlying substrate with a screw (not shown). It is also possible to attach the comer pieces partially or wholly to the anchor sheets 55 through attachment to areas of reduced thickness 53, in which case in some instances it may not be necessary to attach any corner pieces 51 to the substrate, instead letting anchor sheets 55 and corner pieces 51 float on the substrate.

Attachment of corner pieces at the comer reduces the number of attachment points required, because each corner piece overlaps four sheets at one corner. Because the corners of anchor sheets are an area of weakness (as previously stated) there is less likely to be discontinuities or breakage with this attachment system. In addition, because fewer attachment points are required there is less degradation to the integrity of the anchor sheet because there are fewer holes in the anchor sheet. Finally, because the corner pieces hold the anchor sheets down without necessarily attaching them to the underlying floor it is possible to allow for movement of the anchor sheets in relation to the corner pieces, including the handling of atmospheric expansion.

While corner pieces have been described, it is possible to use the invention by providing a reduced thickness area along any edge of a modular anchor sheet and having a cut away area within the reduced thickness area to provide a structure for use of the attachment devices described at that point. A reduced thickness area surrounding a cut away area may also be located anywhere in the interior of an anchor sheet for use of the attachment devices at that interior point.

In embodiments where the anchor sheet modules are attached to the floor only through the corner pieces, the anchor sheet modules can easily be removed and replaced if they are defective or require repair.

It is expected that the modules would likely be square, and preferably in the range of four feet by four feet to two feet by two feet, although modules outside of this range are also functional and fall within the scope of this invention.

The anchor sheet modules could be made of an extruded or molded material in which the two pieces are thermally bonded so as to form an overlap and underlay. The sheets could be cut by a gauge or jig. The anchor sheet modules could be die cut. A layer of hooks could be thermally bonded to the surface of the top sheet. Alternatively, the complete module (potentially including hooks, and the two "layers" of the module) could be injection-molded using a one- or two-step or multi-step process mold, using materials such as polypropylene or polyethylene.

The overlap and underlay areas of the modules may be provided with means for detachable or permanent attachment, or the underlay areas may simply lie underneath and support the overlap areas without any form of attachment. Alternatively, the modules may also be made with corresponding registering bumps and indentations (not shown) in the overlap and underlay portions of the modules to assist in retaining the modules together and in alignment during installation.

In all cases where hook and loop systems or hooks are provided for, the hooks may be temporarily covered by a hard slip covering as discussed in U.S. application Ser. No. 08/850,726 or a soft covering as disclosed in U.S. Pat. No. 4,822,658 to temporarily prevent premature engagement of the hooks to loops.

It is noted that those skilled in the art will appreciate that various modifications of detail may be made from the embodiments described herein which would come within the spirit and scope of the invention as described in the following claims.

I claim:

1. An anchor sheet shaped to have a substantially flat square lower layer part having an underside covered in a resilient cushion and a substantially flat square upper layer part of the same size as the lower layer part having an upper side substantially covered in hooks in which the upper layer part is offset from the lower layer part an equal amount along two adjacent edges to expose two adjacent portions of the lower layer part and in which countersunk holes are formed through the anchor sheet centred on the corners formed by the lower layer part.

2. An anchor sheet for use in a subfloor for detachable attachment to a decorative covering, the anchor sheet comprising:

an upper surface having a means for detachable attachment to the decorative covering;

a lower surface opposite the upper surface, the lower surface being covered with a resilient layer;

a recess of a first shape reducing the thickness of the anchor sheet in a first area;

a complete cut through the anchor sheet of a smaller second area within the first area of a second shape;

wherein the anchor sheet has at least two adjacent edges which have a lower portion cut away to create an overhanging area of anchor sheet and at least two adjacent lower edges substantially under the overhang; and the anchor sheet has at least two adjacent edges which have an upper portion cut away to create an underlay area of anchor sheet leaving at least two adjacent underlay edges at the outer edge oft underlay.

3. The anchor sheet of claim 2, wherein the means for attachment are hooks for use a hook and loop attachment system.

4. The anchor sheet of claim 3, wherein the resilient layer is a structure that has the properties of a resilient cushion.

5. The anchor sheet of claim 3, wherein the anchor sheet is rectangular.

6. A square anchor sheet for use in a subfloor for detachable attachment to a decorative covering, the decorative covering having a lower surface substantially covered by loops, the square anchor sheet comprising:

an upper surface substantially covered by hooks, the hooks for attachment to the loops of an overlaid decorative covering;

a lower surface opposite the upper surface, the lower surface being covered with a resilient layer;

two adjacent edges which have a lower portion cut away to create an overhanging area of anchor sheet and two adjacent lower edges substantially under the overhang;

two adjacent edges which have an upper portion cut away to create an underlay area of anchor sheet leaving at least two adjacent underlay edges at the outer edge of the underlay;

four circular recesses reducing the thickness of the anchor sheet;

one of the circular recesses centred on the apexes of the angles formed by the two lower edges;

one of the circular recesses centred on the apexes of the angles formed by the two underlay edges;

two of the circular recesses centred on the apexes of the angles formed by an underlay edge and a lower edge;

four circular complete cuts through the anchor sheet of a smaller diameter than the four circular recesses; and the four circular complete cuts located at the centre of the four circular recesses.

7. An anchor sheet for use in a subfloor for detachable attachment to a decorative covering, the anchor sheet comprising:

an upper surface having a means for detachable attachment to the decorative covering;

a lower surface opposite the upper surface;

a recess of a first shape reducing the thickness of the anchor sheet in a first area;

a complete cut Through the anchor sheet of a smaller second area within the first area of a second shape;

wherein the anchor sheet has at least two adjacent edges which have a lower portion cut away to create an overhanging area of anchor sheet and at least two adjacent lower edges substantially under the overhang; and the anchor sheet has at least two adjacent edges which have an upper portion cut away to create an underlay area of anchor sheet leaving at least two adjacent underlay edges at the outer edge of the underlay.

* * * * *